US007341447B2

(12) United States Patent
Guinther et al.

(10) Patent No.: US 7,341,447 B2
(45) Date of Patent: Mar. 11, 2008

(54) DELIVERING MANGANESE FROM A LUBRICANT SOURCE INTO A FUEL COMBUSTION SYSTEM

(75) Inventors: Gregory H. Guinther, Richmond, VA (US); Vincent J. Gatto, Midlothian, VA (US); Joseph W. Roos, Mechanicsville, VA (US)

(73) Assignee: Afton Chemical Intangibles, Richmond, VA (US)

( * ) Notice: Subject to any disclaimer, the term of this patent is extended or adjusted under 35 U.S.C. 154(b) by 213 days.

(21) Appl. No.: 10/313,310

(22) Filed: Dec. 6, 2002

(65) Prior Publication Data

US 2004/0110104 A1 Jun. 10, 2004

(51) Int. Cl.
*F23J 7/00* (2006.01)

(52) U.S. Cl. ..... 431/4; 44/359; 44/366

(58) Field of Classification Search ..... 431/4; 44/359, 366

See application file for complete search history.

(56) References Cited

U.S. PATENT DOCUMENTS 4,028,065 A * 6/1977 Sprague et al. ..... 44/360
4,235,447 A * 11/1980 Davison, Jr. ..... 277/462
4,266,946 A * 5/1981 Niebylski ..... 44/360
4,674,447 A * 6/1987 Davis ..... 123/1 A
5,464,549 A 11/1995 Sieberth
5,498,355 A 3/1996 Perozzi et al.
5,823,758 A * 10/1998 Lack ..... 431/4
5,942,475 A * 8/1999 Schlosberg et al. ..... 508/492
6,200,358 B1 3/2001 Fleischer et al.
6,629,407 B2 * 10/2003 Roos et al. ..... 60/274

FOREIGN PATENT DOCUMENTS

| | | |
|---|---|---|
| EP | 1 215 272 A1 | 6/2002 |
| EP | 1 321 506 A2 | 6/2003 |
| EP | 1 378 560 A2 | 1/2004 |
| EP | 1 378 560 A3 | 1/2004 |
| GB | 2 308 381 A | 6/1997 |

* cited by examiner

*Primary Examiner*—Alfred Basichas
(74) *Attorney, Agent, or Firm*—John H. Thomas, P.C.

(57) ABSTRACT

The present invention relates to an apparatus and method for delivering manganese from a lubricant source into a fuel combustion system or to the exhaust therefrom. By the present invention, manganese from the lubricant will interact with phosphorus, sulfur, and/or lead from the combustion products. In this manner, the manganese scavenges or inactivates harmful materials which have migrated into the fuel or combustion products, and which can otherwise poison catalytic converters, sensors and/or automotive on-board diagnostic devices. The present invention can also lead to improved durability of exhaust after treatment systems.

28 Claims, 3 Drawing Sheets

Activity at Catalyst Front

DELIVERING MANGANESE FROM A LUBRICANT SOURCE INTO A FUEL COMBUSTION SYSTEM

FIELD OF THE INVENTION

The present invention relates to an apparatus and method for delivering manganese from a lubricant source into a fuel combustion system or to the exhaust therefrom. By the present invention, manganese from the lubricant will interact with phosphorus, sulfur, and/or lead from the combustion products. In this manner, the manganese scavenges or inactivates harmful materials which have migrated into the fuel or combustion products, and which can otherwise poison catalytic converters, sensors and/or automotive on-board diagnostic devices. The present invention can also lead to improved durability of exhaust after treatment systems.

BACKGROUND OF THE INVENTION

A problem exists in fuel combustion systems in which the fuel contains, or acquires, or produces upon combustion, one or more metal (e.g. lead), sulfur, and/or phosphorus contaminants that can poison or degrade catalytic converters, sensors, or on-board diagnostic devices.

An additional problem is created by such contaminants in the form of undesirably increased levels of certain combustion products or by-products in the exhaust.

Yet another problem from such contaminants is a detrimental effect on after treatment systems. These contaminants can include elemental phosphorus, lead and sulfur, or compounds thereof in the fuel, or in the air. The contaminants can also get into the fuel, or the combustion chamber, or the combustion exhaust stream from the engine or combustion system lubricants which often contain phosphorus-containing and sulfur-containing additives, and lead compounds associated with combustion system wear.

It is a well-known phenomenon that vehicles and other combustion systems consume, that is the engine burns, oil used as a lubricant for the engine or moving parts of a combustion system. Various pathways exist for lubricating oil to enter the combustion system, and/or its exhaust stream. Clearly the various components or additives in the lubricating oil also are consumed or burned and these components or additives can have deleterious effects on the combustion system's catalysts, after treatment system, and emissions.

It is therefore desirable to inhibit, reduce or prevent the deleterious interaction of components (such as phosphorus, lead and/or sulfur arising from the lubricant source, air or fuel or otherwise entering the combustion process) with the combustion exhaust stream to thereby prevent catalyst poisoning, after treatment system malfunction, and increased emissions.

SUMMARY OF THE INVENTION

In an embodiment, the present invention provides a method to inhibit, reduce or prevent the deleterious interaction of components (such as phosphorus, lead and/or sulfur arising from the lubricant source, any processing aid or adjuvant, fuel, fuel additive, air or otherwise entering the combustion process) with the combustion exhaust stream to thereby prevent catalyst poisoning, sensor poisoning, after treatment system malfunction, and/or increased emissions.

In another embodiment, the present invention provides a system for scavenging phosphorus, lead and/or sulfur from a fuel or the products resulting from the combustion of the fuel.

The present invention further relates to methods to improve the durability of an after treatment device for a combustion system, wherein the method includes contacting the products of the combustion of a hydrocarbonaceous fuel with a lubricant containing manganese in an amount sufficient for the manganese to interact with one or more contaminants selected from the group consisting of phosphorus, sulfur, lead or compounds thereof in said products to thereby reduce the amount of one or more of the contaminants contacting the after treatment device.

By "manganese" herein is meant any organomanganese compound or material, including but not limited to methyl cyclopentadienyl manganese tricarbonyl, available as MMT® from Ethyl Corporation, manganese sulfonate, manganese phenate, manganese salicylate, alkyl cyclopentadienyl manganese tricarbonyl, organic manganese tricarbonyl derivatives, alkyl cyclopentadienyl manganese derivatives, neutral and overbased manganese salicylates, neutral and overbased manganese phenates, neutral and overbased manganese sulfonates, manganese carboxylates, and combinations and mixtures thereof. The manganese is preferably present in the lubricant as an oil-soluble additive that can volatilize and thereby enter the combustion chamber or exhaust stream. It may also enter the combustion chamber through "bulk" consumption, i.e., past valve guides or around piston rings. In one embodiment, the fuel or the exhaust from its combustion is treated with a low level of manganese, such as for example, a manganese level of about 20 ppm Mn in the fuel or combustion exhaust or less.

By "base oil" herein is meant a base oil which can be selected from the group consisting of paraffinic, naphthenic, aromatic, poly-alpha-olefins, synthetic esters, and polyol esters, and mixtures thereof. In a preferred embodiment, the base oil contains less than or equal to 0.03 wt. % sulfur, and greater than or equal to 90 wt. % saturates, and has a viscosity index greater than or equal to 80 and less than or equal to 120. In another embodiment, the base oil contains less than or equal to 0.03 wt. % sulfur, and greater than or equal to 90 wt. % saturates, and has a viscosity index greater than or equal to 120. In a more preferred embodiment, the base oil is substantially sulfur-free.

By "scavenging" herein is meant the contacting, combining with, reacting, incorporating, chemically bonding with or to, physically bonding with or to, adhering to, agglomerating with, affixing, inactivating, rendering inert, consuming, alloying, gathering, cleansing, consuming, or any other way or means whereby a first material makes a second material unavailable or less available.

By "interaction", "interacting" and "interacts" herein is meant scavenging.

By "inactivating" herein is meant scavenging.

By "hydrocarbonaceous fuel" herein is meant hydrocarbonaceous fuels such as but not limited to diesel fuel, jet fuel, alcohols, ethers, kerosene, low sulfur fuels, synthetic fuels, such as Fischer-Tropsch fuels, liquid petroleum gas, fuels derived from coal, genetically engineered biofuels and crops and extracts therefrom, natural gas, propane, butane, unleaded motor and aviation gasolines, and so-called reformulated gasolines which typically contain both hydrocarbons of the gasoline boiling range and fuel-soluble oxygenated blending agents, such as alcohols, ethers and other suitable oxygen-containing organic compounds. Oxygenates suitable for use in the fuels of the present invention include methanol, ethanol, isopropanol, t-butanol, mixed alcohols, methyl tertiary butyl ether, tertiary amyl methyl ether, ethyl tertiary butyl ether and mixed ethers. Oxygenates, when used, will normally be present in the reformulated gasoline fuel in an amount below about 25% by volume, and preferably in an amount that provides an oxygen content in the overall fuel in the range of about 0.5 to about 5 percent by volume. "Hydrocarbonaceous fuel" or "fuel" herein shall also mean gasoline, bunker fuel, coal (dust or slurry), crude oil, refinery "bottoms" and by-products, crude oil extracts, hazardous wastes, yard trimmings and waste, wood chips and saw dust, agricultural waste, fodder, silage, plastics and other organic waste and/or by-products, and mixtures thereof, and emulsions, suspensions, and dispersions thereof in water, alcohol, or other carrier fluids. By "diesel fuel" herein is meant one or more fuels selected from the group consisting of diesel fuel, biodiesel, biodiesel-derived fuel, synthetic diesel and mixtures thereof. It is preferred that the hydrocarbonaceous fuel is substantially sulfur-free, by which is meant a sulfur content not to exceed on average about 30 ppm of the fuel.

By "combustion system" and "apparatus" herein is meant, for example and not by limitation herein, any diesel-electric hybrid vehicle, a gasoline-electric hybrid vehicle, a two-stroke engine, any and all burners or combustion units, including for example and without limitation herein, stationary burners, waste incinerators, diesel fuel burners, diesel fuel engines, automotive diesel engines, gasoline fuel burners, gasoline fuel engines, power plant generators, and the like. The hydrocarbonaceous fuel combustion systems that may benefit from the present invention include all combustion units, systems, devices, and/or engines that burn fuels. By "combustion system" herein is also meant any and all internal and external combustion devices, machines, engines, turbine engines, jet engines, boilers, incinerators, evaporative burners, plasma burner systems, plasma arc, stationary burners, and the like which can combust or in which can be combusted a hydrocarbonaceous fuel.

By "contacting" herein is meant the contacting, bringing together, reacting, complexing, coordinating, combining, admixing, mixing, and the like association between two or more materials, whether or not a chemical or physical reaction or change occurs.

By "essentially free of phosphorus and compounds thereof" is meant an amount of elemental phosphorus or a compound thereof which is less than about 10 ppm in the lubricant. Such low levels of phosphorus are desirable in many current lubricant formulations, and it is anticipated that lower levels of phosphorus in lubricants will be continually sought, perhaps required. A preferred level of phosphorus in the lubricant is an amount between 1 ppm and approximately 1500 ppm. A more preferred level of phosphorus in the lubricant is an amount between 500 ppm and 1200 ppm.

By "after treatment system" or "after treatment device" herein is meant any system or device which contacts the combustion product(s) from a combustion chamber in a manner designed to oxidize, reduce or otherwise treat the combustion product(s). Examples, but not by way of limitations herein, of such after treatment systems include an automobile three-way catalytic converter, lean $NO_x$ traps, catalyzed diesel particulate filter and a continuously regenerating technology diesel particulate filter. "After treatment system" also includes associated sensors like $O_2$ sensors and $NO_x$ sensors. Analogous gasoline combustion after treatment systems are known and are included herein as deriving benefit from the present invention.

It is to be understood that both the foregoing general description and the following detailed description are exemplary and explanatory only and are intended to provide further explanation of the present invention, as claimed.

DETAILED DESCRIPTION OF THE PRESENT INVENTION

In a more specific embodiment, the present invention provides a method for reducing the amount of, or the deleterious effect from, at least one contaminant selected from the group consisting of phosphorus, lead, sulfur, and compounds thereof in an exhaust stream from the combustion of a hydrocarbonaceous fuel in a combustion system lubricated by a lubricant, said method including the steps: (a) lubricating the combustion system with the lubricant comprising a major amount of a base oil of lubricating viscosity and a minor amount of one or more additives comprising (i) at least one organosulfur compound, or at least one organophosphorus compound, or both, and (ii) at least one manganese source; (b) combusting in the combustion system the hydrocarbonaceous fuel to produce combustion products comprising at least one material selected from the group consisting of sulfur, lead, phosphorus, and compounds thereof; and (c) contacting the manganese with the sulfur, lead, phosphorus, and compounds thereof in the combustion products, whereby the manganese interacts with the sulfur, lead, phosphorus, and/or compounds thereof. This interaction between the manganese and the sulfur, lead, phosphorus, and compounds thereof results in the scavenging of the contaminants, whereby several beneficial results are obtained. By scavenging the contaminants, the beneficial results include maintaining catalytic converter performance, maintaining sensor performance, maintaining LNT performance, and maintaining DPF performance.

Figure 1:
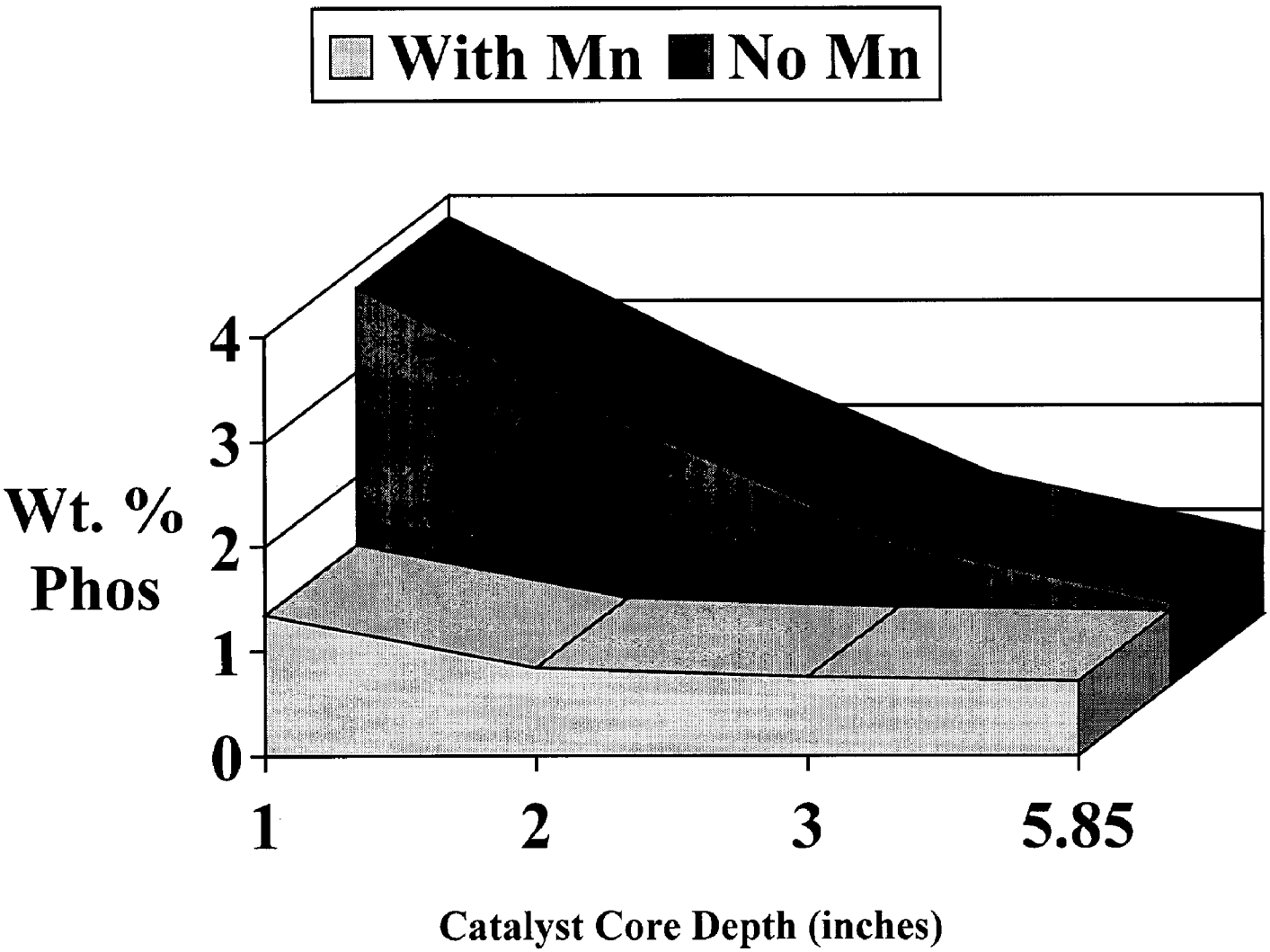
FIG. 1 is graph depicting a comparison of phosphorus deposits for fuel with and without manganese.

When cars are operated with manganese in the fuel, for example when the gasoline has MMTO® Fuel Additives added to it, its has been shown that less phosphorus is deposited on the car's catalytic converter. (See FIG. 1) The graph in FIG. 1 shows that less phosphorus is deposited throughout the catalyst when Mn has been combusted in the fuel. Specifically, FIG. 1 illustrates a greater than 50% reduction (from slightly less than 4 wgt % to about 1.5 wgt %) in the amount of phosphorus on the catalyst when manganese is present in the exhaust. This is consistent with prior data showing Mn is combining in the combustion or exhaust stream with phosphorus to form stable manganese-phosphorus and manganese sulfate species that do not form impermeable glazes on the catalyst. With less phosphorus on the catalyst, less emissions "break through", i.e., pass through as unconverted emissions. Therefore, it is desirable to have Mn in the exhaust stream.

Figure 2:
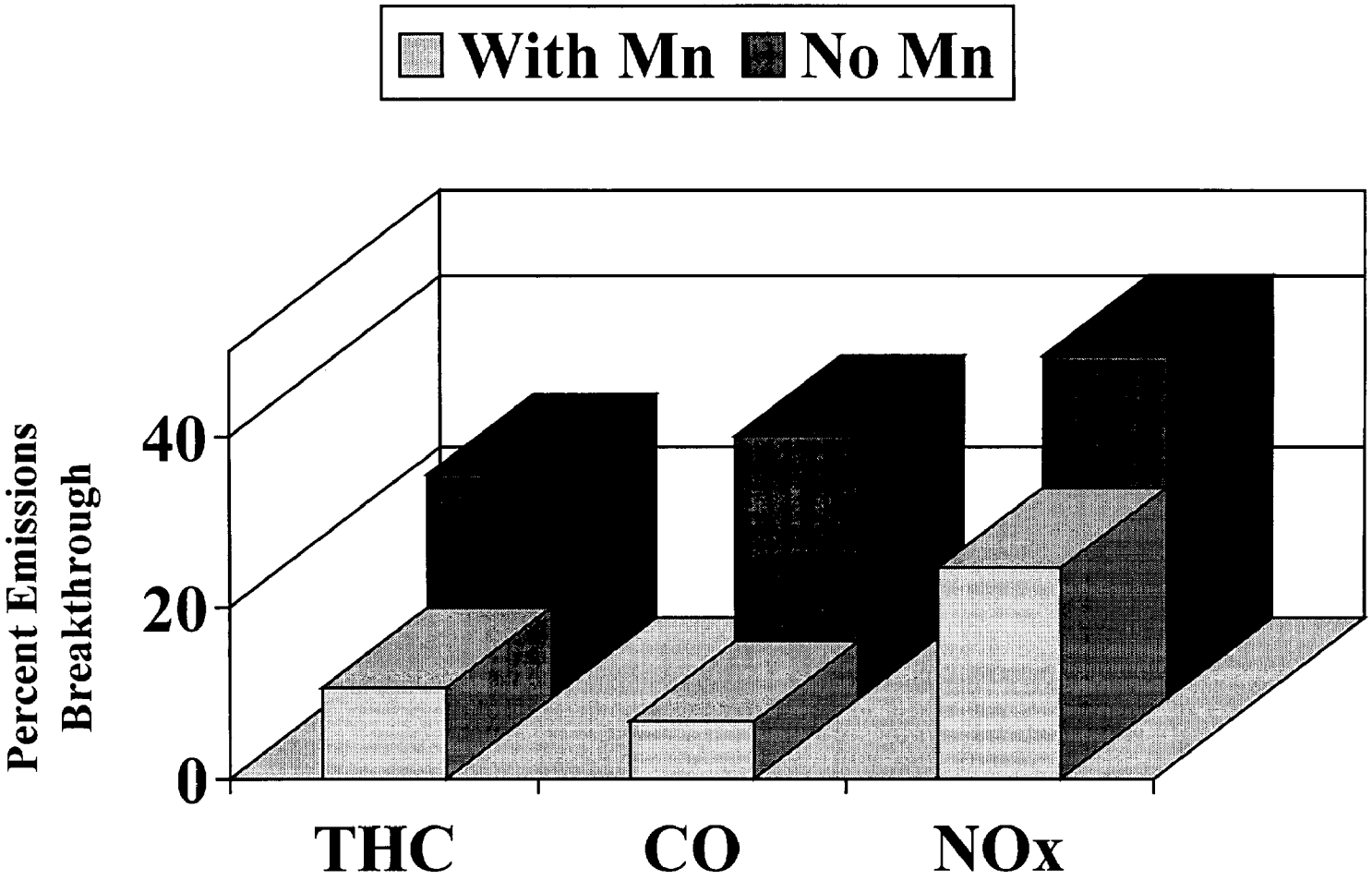
FIG. 2 represents exhaust data showing percent break through based on the presence or absence of manganese.

FIG. 2 represents exhaust data showing percent emissions break through of hydrocarbons, carbon monoxide, and $NO_x$ based on Mn being present or absent in the exhaust. With less phosphorus poisoning, there is improved catalytic activity and lower levels of pollutants break through the catalyst, leading to lower emissions. It is clear in FIG. 2 that the undesirable emissions are significantly lower in the exhaust stream coming from the combustion of fuel containing manganese.

The tests represented in FIG. 1 and FIG. 2 were 1993 Toyota Camry vehicles operated over 100,000 miles on either a base fuel or the base fuel plus 8.3 mg Mn/liter. After accumulating 100,000 miles, the catalytic converters were dismantled and analyzed to determine the weight of phosphorus present at discrete points over their length. The catalysts were also analyzed to determine their efficiency, as measured by the percent of emissions breaking through unconverted. The vehicles operated with Mn in the fuel (from MMT®) had less phosphorus deposited on the catalytic converter, resulting in less emissions breaking through unconverted.

Figure 3:
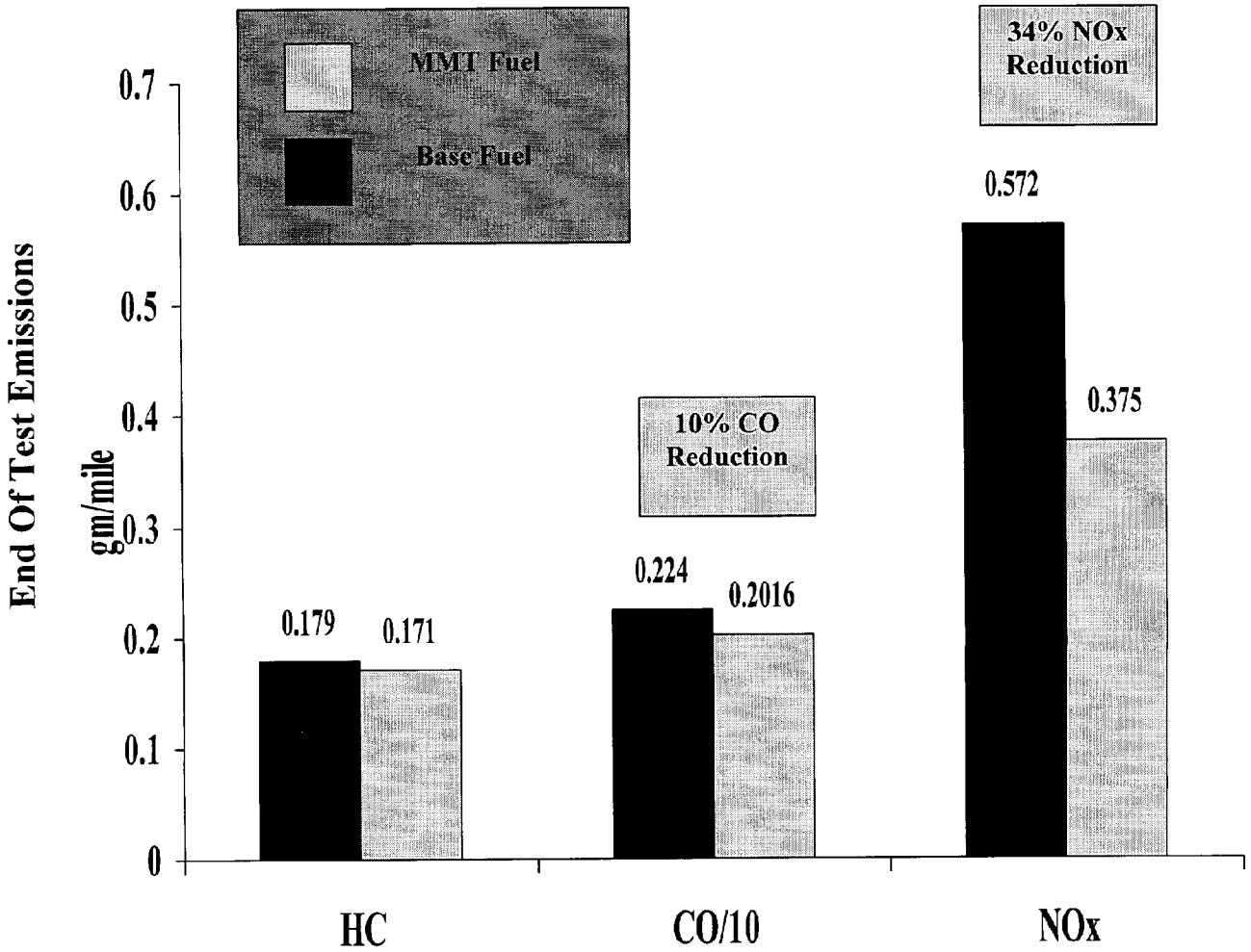
FIG. 3 represents exhaust data showing end of test emissions hydrocarbons, carbon monoxide, and NOx.

Further evidence of phosphorus protection and lower emissions achieved by the presence of manganese in the combustion product of a lubricant containing manganese can be drawn from a 1992/1993 EPA Waiver Fleet test run by Ethyl Corporation, wherein cars burning gasoline containing Mn from the fuel additive MMT® at 8.3 mg Mn/liter produced lower CO and NOx emissions compared to cars burning a baseline FIG. 3, which utilized: 22 vehicles (paired); 1993 Ford Escort TLEV, 1993 Toyota Camry, 1992 Crown Victoria, 1993 Honda Civic TLEV; vehicle selection based on Automotive Company and EPA comments, Public Docket A-92 41, Nov. 9, 1992; mileage acc. fuel—300 ppm S—gasoline detergent used—MMT splash blended; emissions testing on all vehicles completed with the same certification fuel.) The surface of the catalyst in the converter is not able to differentiate the source of the manganese as being a fuel, or a lubricant since these two material are simultaneously combusted far upstream from the catalyst.

In another test, the total suspended particulates (TSP) exhaust gas particulate emissions were collected from two separate Ford Taurus vehicles while operated over seven cycles of the EPA Universal Dynamometer Driving Sequence (UDDS). The filters were analyzed at Lawrence Livermore National Labs using X-ray absorption spectroscopy (XAS) to determine the species of manganese present in the exhaust. The data in Table 1 shows the analysis results, wherein the predominant manganese species are phosphates and sulfates, showing that the manganese is combining with phosphorus and sulfur which is derived from the engine lubricant and fuel.

TABLE 1

| Manganese Speciation by XAS (Wgt % of the exhaust particulates) | |
|---|---|
| Vehicle | Phosphates + Sulfates |
| 1 | 84 |
| 2 | 82 |

The mass analysis in Table 1 has a 95% confidence limit of +/−5%.

It should be understood that the contaminants being scavenged according to the present invention by the manganese from the lubricant can originate from the air utilized in the combustion of the hydrocarbonaceous fuel. In another embodiment, the contaminants being scavenged according to the present invention by the manganese can originate from the hydrocarbonaceous fuel. In yet another embodiment of the present invention, the contaminants being scavenged by the manganese can originate from the lubricant used to lubricate the combustion system.

In one embodiment, the lubricant-borne manganese which will scavenge the contaminant(s) can bleed, "blow-by", flow, seep, be forced or compressed, be drawn, sucked, or. aspirated or otherwise accidentally or deliberately get into a combustion chamber of the combustion system. In this embodiment, the contaminant(s) encounter and interact with the manganese during or after the combustion process, whereby scavenging occurs. Thus an embodiment of a method of the present invention is achieved when lubricant containing manganese escapes around a valve in the combustion system, such as for example and not as a limitation herein, an intake valve or an exhaust valve in an automotive engine. In this manner, the manganese is caused to encounter and interact with the contaminant(s), whereby scavenging can occur.

In another embodiment, the manganese is caused, deliberately or inadvertently, to encounter the contaminant(s) in a passageway through which the combustion products containing the contaminant(s) are conveyed away from the combustion chamber. In this manner, the scavenging occurs outside the combustion chamber of the combustion system.

In another embodiment of the present invention, the manganese volatilizes from the lubricant and is carried over into the combustion chamber containing the fuel.

In yet another embodiment, the combustion system utilizes a deliberate recirculating process, whereby vapors in a crankcase are recirculated into either the intake manifold of the combustion chamber. In this manner, any lubricant containing the phosphorus, sulfur, and/or lead contaminants is caused to encounter and interact with manganese in the combustion or exhaust.

Thus, in another test, a 1997 Ford Taurus was operated over seven cycles of the EPA UDDS. The fuel used during testing contained 8.3 mg Mn/liter. The engine oil used in the crankcase had a phosphorus concentration of 1000 ppm. The total mass of phosphorus and manganese consumed during the test were determined by mass-balance. TSP exhaust emissions were collected and analyzed to determine mass of manganese and phosphorus present on the filter. It was determined that the molar ratio of phosphorus to manganese on the TSP filters was equivalent to or commensurate with the mass of those elements consumed through fuel and oil consumption. Table 2 illustrates the molar ratio of P:Mn consumed as calculated and the mass collected on the filters.

TABLE 2

| Vehicle Operation, Oil Consumption, Manganese Consumption and Molar Ratios | |
|---|---|
| Ratio of P:Mn | Measured P:Mn on Filters |
| 0.27 | 0.32 |

The present invention provides in another embodiment an apparatus for performing a method for reducing the amount of, or deleterious effect of, at least one contaminant selected from the group consisting of phosphorus, lead, sulfur and compounds thereof in an exhaust stream, wherein the apparatus contains (a) a combustion chamber adapted to combust a hydrocarbonaceous fuel; (b) a means to introduce the hydrocarbonaceous fuel into the combustion chamber; (c) a means to convey combustion product from the combustion chamber; and (d) a lubricant comprising a major amount of a base oil of lubricating viscosity and a minor amount of one or more additives comprising (i) at least one organosulfur compound, or at least one organophosphorus compound, or both, and (ii) at least one manganese source. The apparatus can further contain an after treatment device or system.

According to one embodiment of the present invention, the organosulfur compound in the lubricant can be selected from the group consisting of sulfurized olefins, sulfurized fats and vegetable oils, sulfurized unsaturated esters and amides, ashless and metal containing dithiocarbamates, substituted thiadiazoles, sulfurized hindered phenols, sulfurized alkylphenols, neutral metal-containing sulfonate detergents, overbased metal-containing sulfonate detergents, neutral metal-containing phenate detergents, and overbased metal-containing phenate detergents, or combinations and mixtures thereof.

According to another embodiment, the organophosphorus compound in the lubricant can be selected from the group consisting of primary, secondary and aryl neutral and overbased zinc dialkyldithiophosphates (ZDDP's), trialkyl- and triarylphosphites, mixed alkyl/aryl phosphites, alkyl and aryl phosphorothiolthionates, and alkyl and aryl phosphorothionates, and combinations or mixtures thereof.

It has been observed that a significant reduction in the amount of phosphorus detected on a device such as a catalyst can be achieved when manganese from methyl cyclopentadienyl manganese tricarbonyl is in the exhaust stream from a combustion system. Specifically, reductions in the amount of such contaminants above 20% by weight, and more preferably reductions in an amount of from 60% to 80% by weight detected on the after treatment device will be achieved by the present invention. This produces a dramatic and highly desirable benefit in the improved durability of such after treatment devices or systems.

The accompanying FIGS. 1, 2 and 3 further illustrate aspects of the present invention but do not limit the present invention.

Other embodiments of the present invention will be apparent to those skilled in the art from consideration of the specification, Figures and practice of the invention disclosed herein. It is intended that the specification and Figures be considered as exemplary only, with a true scope and spirit of the invention being indicated by the following claims.

What is claimed is:

1. A method for reducing the deleterious effect of at least one contaminant selected from the group consisting of phosphorus, lead, sulfur and compounds thereof in an exhaust stream from the combustion of a hydrocarbonaceous fuel in a stoichiometric combustion system lubricated by a lubricant, and the combustion system excluding a two-stroke engine, said method comprising the steps:

(a) lubricating the combustion system with the lubricant comprising a major amount of a base oil of lubricating viscosity and a minor amount of one or more additives comprising (i) at least one organosulfur compound, or at least one organophosphorus compound, or both, and (ii) at least one manganese source; and wherein the lubricant is added to the combustion system separate from the fuel;

(b) combusting in the combustion system the hydrocarbonaceous fuel and the lubricant to produce combustion products comprising manganese and at least one material selected from the group consisting of sulfur, lead, phosphorus, and compounds thereof;

(c) contacting the manganese with the sulfur, lead, phosphorus, and compounds thereof in the combustion products, whereby the manganese interacts with the sulfur, lead, phosphorus, and compounds thereof.

2. The method of claim 1, wherein the sulfur, lead, phosphorus, and compounds thereof in the combustion products originate from the fuel.

3. The method of claim 1, wherein the sulfur, lead, phosphorus, and compounds thereof in the combustion products originate from air used in the combustion of the fuel.

4. The method of claim 1, wherein the sulfur, lead, phosphorus, and compounds thereof in the combustion products originate from the lubricant.

5. The method of claim 1, wherein the exhaust stream is essentially free of phosphorus and compounds thereof.

6. The method of claim 1, wherein the combustion system further comprises an after treatment system.

7. The method of claim 1, wherein the combustion system is selected from the group consisting of any, gasoline-electric hybrid vehicle, stationary burners, waste incinerators, gasoline fuel burners, gasoline fuel engines, power plant generators, any and all external combustion devices, turbine engines, jet engines, boilers, incinerators, evaporative burners, plasma burner systems, plasma arc, and stationary burners.

8. The method of claim 1, wherein the hydrocarbonaceous fuel is selected from the group consisting of jet fuel, alcohols, ethers, kerosene, low sulfur fuels, synthetic fuels, Fischer-Tropsch fuels, liquid petroleum gas, fuels derived from coal, genetically engineered biofuels and crops and extracts therefrom, natural gas, propane, butane, unleaded motor and aviation gasolines, reformulated gasolines which contain both hydrocarbons of the gasoline boiling range and fuel-soluble oxygenated blending agents, gasoline, bunker fuel, coal (dust or slurry), crude oil, refinery "bottoms" and by-products, crude oil extracts, hazardous wastes, yard trimmings and waste, wood chips and saw dust, agricultural waste, fodder, silage, plastics, organic waste, and mixtures thereof, and emulsions, suspensions, and dispersions thereof in water, alcohol, and other carrier fluids.

9. An apparatus for performing the method of claim 1, said apparatus comprising:

(a) a combustion chamber adapted to combust a hydrocarbonaceous fuel;

(b) a means to introduce the hydrocarbonaceous fuel into the combustion chamber;

(c) a means to introduce a lubricant into the combustion chamber;

(d) a means to convey combustion product from the combustion chamber; and (e) the lubricant comprising a major amount of a base oil of lubricating viscosity and a minor amount of one or more additives comprising (i) at least one organosulfur compound, or at least one organophosphorus compound, or both, and (ii) at least one manganese source; and wherein the lubricant is added to the combustion system separate from the fuel.

10. The apparatus of claim 9, further comprising an after treatment system.

11. The apparatus of claim 9, wherein the apparatus is selected from the group consisting of any gasoline-electric hybrid vehicle, stationary burners, waste incinerators, gasoline fuel burners, gasoline fuel engines, power plant generators, any and all external combustion devices, turbine engines, jet engines, boilers, incinerators, evaporative burners, plasma burner systems, plasma arc, and stationary burners.

12. The method of claim 1, wherein the organosulfur compound in the lubricant is selected from the group consisting of sulfurized olefins, sulfurized fats and vegetable oils, sulfurized unsaturated esters and amides, ashless and metal containing dithiocarbamates, substituted thiadiazoles, sulfurized hindered phenols, sulfurized alkylphenols, neutral metal-containing sulfonate detergents, overbased metal-containing sulfonate detergents, neutral metal-containing phenate detergents, and overbased metal-containing phenate detergents, or combinations and mixtures thereof.

13. The method of claim 1, wherein the organophosphorus compound in the lubricant is selected from the group consisting of primary, secondary and aryl neutral and overbased zinc dialkyldithiophosphates (ZDDP's), trialkyl- and triarylphosphites, mixed alkyl/aryl phosphites, alkyl and aryl phosphorothiolthionates, and alkyl and aryl phosphorothionates, and combinations or mixtures thereof.

14. The method of claim 1, wherein the manganese source in the lubricant is selected from the group consisting of methyl cyclopentadienyl manganese tricarbonyl, alkyl cyclopentadienyl manganese tricarbonyl, organic manganese tricarbonyl derivatives, alkyl cyclopentadienyl manganese derivatives, neutral and overbased manganese salicylates, neutral and overbased manganese phenates, neutral and overbased manganese sulfonates, manganese carboxylates, and combinations and mixtures thereof.

15. The method of claim 1, wherein the base oil is selected from the group consisting of paraffinic, naphthenic, aromatic, poly-alpha-olefins, synthetic esters, and polyol esters, and mixtures thereof.

16. The method of claim 1, wherein the base oil contains less than or equal to 0.03 wt. % sulfur, and greater than or equal to 90 wt. % saturates, and has a viscosity index greater than or equal to 80 and less than or equal to 120.

17. The method of claim 1, wherein the base oil contains less than or equal to 0.03 wt. % sulfur, and greater than or equal to 90 wt. % saturates, and has a viscosity index greater than or equal to 120.

18. The method of claim 1, wherein the base oil is substantially sulfur-free.

19. The method of claim 1, wherein the hydrocarbonaceous fuel contains low levels of sulfur.

20. The method of claim 1, wherein the hydrocarbonaceous fuel is substantially free of sulfur.

21. The method of claim 1, wherein the hydrocarbonaceous fuel contains low levels of sulfur and is further treated with oxygenates.

22. The method of claim 1, wherein the hydrocarbonaceous fuel is substantially free of sulfur and is further treated with oxygenates.

23. The method of claim 1, wherein the hydrocarbonaceous fuel contains low levels of sulfur and is further treated with low levels of manganese.

24. The method of claim 1, wherein the hydrocarbonaceous fuel is substantially free of sulfur and is further treated with low levels of manganese.

25. A method for reducing the deleterious effect of at least one contaminant selected from the group consisting of phosphorus, lead, sulfur and compounds thereof in an exhaust stream from the combustion of a hydrocarbonaceous fuel in a combustion system lubricated by a lubricant, and the combustion system excluding a two-stroke engine, said method comprising the steps:

(a) lubricating the combustion system with the lubricant comprising a major amount of a base oil of lubricating viscosity and a minor amount of one or more additives comprising (i) at least one organosulfur compound, or at least one organophosphorus compound, or both, and (ii) at least one manganese source; wherein the manganese volatilizes from the lubricant and is carried over into a combustion chamber in the combustion system;

(b) combusting in the combustion system the hydrocarbonaceous fuel to produce combustion products comprising at least one material selected from the group consisting of sulfur, lead, phosphorus, and compounds thereof;

(c) contacting the manganese with the sulfur, lead, phosphorus, and compounds thereof in the combustion products, whereby the manganese interacts with the sulfur, lead, phosphorus, and compounds thereof.

26. A method for reducing the deleterious effect of at least one contaminant selected from the group consisting of phosphorus, lead, sulfur and compounds thereof in an exhaust stream from the combustion of a hydrocarbonaceous fuel in a combustion system lubricated by a lubricant, and the combustion system excluding a two-stroke engine, said method comprising the steps:

(a) lubricating the combustion system with the lubricant comprising a major amount of a base oil of lubricating viscosity and a minor amount of one or more additives comprising (i) at least one organosulfur compound, or at least one organophosphorus compound, or both, and (ii) at least one manganese source; wherein the manganese enters a combustion chamber of the combustion system through bulk consumption;

(b) combusting in the combustion system the hydrocarbonaceous fuel to produce combustion products comprising at least one material selected from the group consisting of sulfur, lead, phosphorus, and compounds thereof;

(c) contacting the manganese with the sulfur, lead, phosphorus, and compounds thereof in the combustion products, whereby the manganese interacts with the sulfur, lead, phosphorus, and compounds thereof.

27. The method of claim 1, wherein the combustion system utilizes a deliberate recirculating process, whereby vapors in a crankcase are recirculated into either the intake manifold or the combustion chamber.

28. The method of claim 6, wherein the deleterious effect of at least one contaminant on the after treatment system is reduced.

* * * * *